US007066666B2

(12) United States Patent
Chae

(10) Patent No.: US 7,066,666 B2
(45) Date of Patent: Jun. 27, 2006

(54) METHOD AND APPARATUS FOR CONTROLLING A SET PAPER IN AN IMAGE FORMING DEVICE

(75) Inventor: Seok-Heon Chae, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 83 days.

(21) Appl. No.: 10/845,136

(22) Filed: May 14, 2004

(65) Prior Publication Data

US 2005/0089354 A1 Apr. 28, 2005

(30) Foreign Application Priority Data

Oct. 22, 2003 (KR) ..... 10-2003-0073995

(51) Int. Cl.
*B41J 11/44* (2006.01)

(52) U.S. Cl. ..... 400/76; 400/70; 399/45

(58) Field of Classification Search ..... 400/76, 400/70, 60; 399/33, 44, 45, 53, 67, 69; 358/1.9
See application file for complete search history.

(56) References Cited

U.S. PATENT DOCUMENTS 5,809,367 A * 9/1998 Yoo et al. ..... 399/45
6,611,353 B1 * 8/2003 Richards ..... 358/1.6
6,804,478 B1 * 10/2004 Martin et al. ..... 399/45

FOREIGN PATENT DOCUMENTS

| | | |
|---|---|---|
| JP | 5-66636 | 3/1993 |
| JP | 6-19257 | 1/1994 |
| JP | 7-27694 | 1/1995 |
| JP | 10-232580 | 9/1998 |
| JP | 11-255352 | 9/1999 |
| JP | 2000-347538 | 12/2000 |
| KR | 1994-26676 | 12/1994 |

* cited by examiner

*Primary Examiner*—Minh Chau
(74) *Attorney, Agent, or Firm*—Staas & Halsey LLP

(57) ABSTRACT

A method and apparatus to control a set paper in an image forming device. When the user sets a type of paper unsupported by a cassette, the method and apparatus of the present invention generates a warning message that the setting is incorrect, and resets the type of paper in response to a user selection or converts the set type of paper into a different type of paper which has printing conditions similar to those of the set type of paper and is supportable by the cassette in order to prevent degradation of image quality in the unsupportable type of paper. Therefore, although a paper such as an envelope or a card requiring a high fixing temperature may be set, when a thin paper is inserted into the cassette to be printed, a printer engine can be protected from an unsuitably high temperature.

28 Claims, 7 Drawing Sheets

FIG.7

PRIOR ART

| TYPE OF PAPER | FIXING TEMPERATURE IN PRINTING |
|---|---|
| Thin | 172 |
| Plain | 189 |
| Bond, Label | 199 |
| Card, Envelope | 208 |
| OHP | 165 |

METHOD AND APPARATUS FOR CONTROLLING A SET PAPER IN AN IMAGE FORMING DEVICE

CROSS-REFERENCE TO RELATED APPLICATIONS

This application claims the benefit of Korean Application No. 2003-73995, filed Oct. 22, 2003, in the Korean Intellectual Property Office, the disclosure of which is incorporated herein by reference.

BACKGROUND OF THE INVENTION

1. Field of the Invention

The present invention relates to a method and apparatus to control a set paper in an image forming device. More particularly, when a user operates a printer driver or a panel of the image forming device to set a type of paper which is not coincident with a paper which is actually fed, that is, the user makes a print instruction by selecting a type of paper unsupportable by a cassette, the invention generates a warning message to inform the user of the unsuitable type of paper. The invention also sets a new type of paper or converts the set type of paper into a suitable type of paper so that an image can be formed on a new paper or a suitable paper.

2. Description of the Related Art

In general, electrophotography is widely used in an image forming device such as a copying machine, a Laser Beam Printer (LBP) and a plain paper facsimile. As well known in the art, the electrophotogrphy includes electrification, exposure, development, transference and fixing.

FIG. 1 schematically illustrates an engine mechanism in an electrophotographic image forming device utilizing contact electrification.

The contact electrification as show in FIG. 1 is generally used to minimize ozone generation induced from electrification, in which a conductive roller or brush functioning as a contact-electrifying body is contacted with a photoconductive drum to form a predetermined level of surface potential on the photoconductive drum. In particular, FIG. 1 illustrates the conductive roller which is utilized in contact electrification.

As shown in FIG. 1, an engine driving motor (not shown), functioning as a main motor of an engine, turns the photosensitive drum 10 clockwise, as indicated with an arrow, corresponding to process operations which are executed by an electrophotographic processor.

First, electrification uses a charge roller 12 or a contact charger to form uniform electric charge on the photosensitive drum 10. The charge roller 12 has a negative potential owing to a negative charging voltage or $V_{CH}$.

The photosensitive drum 10 is charged through contact with the charge roller 12 to have a negative surface potential, which is typically approximately −800V. In these circumstances, feed rollers 30 and 32 feed a paper from a paper cassette (not shown) toward a developing unit of an apparatus body.

Second, in an exposure operation, the charged photosensitive drum 10 is exposed to light corresponding to a draft or an image data to form an electrostatic latent image thereon, in which a Laser Scanning Unit (LSU) 14 is used to selectively expose a portion of the photosensitive drum 10 corresponding to an image area to be printed, so as to form the electrostatic latent image thereon. Because the exposed portion of the photosensitive drum 10 changes its surface potential but the remaining portion of the photosensitive drum, which is not exposed to light, maintains the surface potential, the electrostatic latent image is formed with a potential difference between the exposed and un-exposed portions of the photosensitive drum 10.

Third, in a development operation, developer is attached to the electrostatic latent image on the photosensitive drum 10 to convert the latent image into a visible image. That is, a developing roller 16 is typically applied with a developing bias voltage $V_D$ of about −450V to have a negative potential so that the developer is coated on the developing roller 16. A doctor blade (not shown) regulates the quantity of developer so that the developer is uniformly coated on the developing roller 16. Then, developer having a negative potential is partially moved from developing areas to the exposed regions of the photosensitive drum 10 under potential difference so that developer attached to the photosensitive drum 10 converts the latent image into the visible image.

Fourth, developer is transferred from the photosensitive drum 10 to the paper by a transfer roller 18. The transfer roller 18 is applied with a transfer voltage Vt of about +800 to +1500V so that developer is transferred to the paper from the photosensitive drum 10.

Fifth, in a fixing operation, after transference of developer, the paper passes between a hot heat roller 20 and a high pressure roller 22 so that melted toner is fixed to the paper. Upon completion of fixing toner to the paper, the image forming device discharges the paper to complete a single copying or printing process with respect to the paper.

Hereinafter an image forming device having such an engine mechanism of the prior art will be described in brief with reference with FIG. 2.

FIG. 2 is a block diagram schematically illustrating an image forming device. As shown in FIG. 2, the image forming device comprises a host interface 100, a memory 110, a control panel 120, a controller 130, an engine interface 140, an engine controller 150 and a printer engine 160. The host interface 100 interfaces signals and data communicated between a host such as a personal computer or PC and the controller 130. The memory 110 stores application programs executed by the controller 130, associated information and a variety of data which are generated in response to execution of the control 130. The control panel 120 includes, for example, a key input to allow a user to input various instructions (e.g., type of paper setting, initialization and reset) into the image forming device and a display to provide various information to the user. The engine interface 140 interfaces signals and data communicated between the controller 130 and the engine controller 150. The engine controller 150 controls the printer engine 160 in response to various signals and data which are provided through the engine interface 140 from the controller 130. That is, when the controller 130 inputs a print instruction according to a set type of paper, the engine controller 150 determines transfer temperature and high pressure values according to the set type of paper and provides the determined values to the printer engine 160. The printer engine 160 carries out electrification, exposure, development, transference and fixation according to the set type of paper by using data from the engine controller 150 in order to perform paper printing.

Hereinafter a paper printing method of the image forming device having the above construction will be described in order of operation with reference to FIGS. 2 and 3.

FIG. 3 is a flow chart schematically illustrating a process of controlling a set paper in an image forming device of the prior art.

First, a user sets the type of a paper to be printed in 101. That is, as the user sets the type of the paper to be printed via a printer driver of the personal computer, a paper-setting data is provided to the controller 130 via the host interface 100. Alternatively, if the user sets the type of paper to be printed by using the control panel 120 of the image forming device, the paper-setting data is also provided to the controller 130.

The controller 130 receives the paper-setting data inputted via the host interface 100 or the control panel 120, and provides the paper-setting data to the engine controller 150 via the engine interface 140.

The engine controller 150 recognizes the paper-setting data provided via the engine interface 140 from the controller 130, and determines a fixing temperature corresponding to the set type of paper and a voltage of a high voltage unit to fix an image on the paper in 102.

The values of fixing temperature and voltage are provided to the printer engine 160, which prints the corresponding paper based upon the values provided from the engine controller 150 in 104.

That is, if the user selects an automatic feed mode instead of designating a specific feeder at the time of setting the type of paper to be printed via operation of the printer driver of the personal computer or the control panel 120 of the image forming device itself, a paper is fed by the cassette containing papers according to the priority of feeders.

Since there is no information about a set feeder to feed the paper in the case of the automatic feed mode, all types of papers supported by the image forming device may be set. However, an automatic feeder in the form of a cassette may not feed some types of papers. For example, the cassette type feeder may not support an envelope or a card since it is too thick to be fed by the cassette. In this circumstance, toner formed on the envelope or the card is fixed at a temperature which is higher than that of a plain paper. Also, a high voltage to form the image on the paper is also different according to the type of paper.

Accordingly, if the plain paper is loaded in the cassette and the envelope or a card is erroneously set, unsuitably high values of temperature and voltage are applied to the plain paper to degrade the quality of an image. Furthermore, since the image forming device is operated at the high temperature, a fixing unit can be damaged if used for a long time period.

SUMMARY OF THE INVENTION

It is an aspect of the present invention to provide a method and apparatus to control a set paper in an image forming device, when a user operates a printer driver or a panel of the image forming device to set a type of paper which is not coincident with a paper which is actually fed, that is, the user makes a print instruction by selecting a type of paper which is unsupportable by a cassette, the method or apparatus of the invention generates a warning message to inform the user of the unsuitable type of paper and again sets a new type of paper or converts the set type of paper into a suitable type of paper so as to improve the quality of an image and ensuring the stability of a fixing unit.

Additional aspects and/or advantages of the invention will be set forth in part in the description which follows and, in part, will be obvious from the description, or may be learned by practice of the invention.

An electrophotographic image forming device according to the present invention is provided. The device includes a controller, to set a type of paper, to judge whether the type of paper is supported by a cassette if a paper feed mode is set as a cassette mode, to determine values of fixing temperature and high voltage according to the type of paper, and to form an image on an associated paper according to the determined values of fixing temperature and high voltage.

The electrophotographic image of the invention may further comprise a display to display a warning message if the controller judges that the set type of paper is unsupportable by the cassette, and the display may comprise at least one of a group including an LCD (Liquid Crystal Display), an LED (Light Emitting Diode) and a buzzer.

If the set type of paper is judged unsupportable by the cassette, the controller selects a supportable type of paper having image forming conditions similar to those of the set type of paper and determines values of fixing temperature and high voltage according to the selected supportable type of paper to form the image.

Another aspect of the present invention provides a method to control an image forming device. The method includes: setting a type of paper to form an image; judging a current feed mode of the image forming device; determining whether the type of paper is supportable by an cassette of the image forming device if the current feed mode is set as a cassette feed, type of paper is supportable by an cassette of the image forming device; and determining values of fixing temperature and high voltage of the supportable type of paper to form an image on a set paper.

If the determining operation determines that the current feed mode is set as the cassette feed and the set type of paper is unsupportable by the cassette, the method of the invention may further comprise the operation of generating a warning message, wherein the warning message is generated in the form of a text message or a sound by using at least one of a group including an LCD, an LED and a buzzer.

If the set type of paper is judged to be unsupportable by the cassette, the image forming operation selects a supportable type of paper having image forming conditions similar to those of the set type of paper and determine values of fixing temperature and high voltage according to the selected supportable type of paper to form the image.

Another aspect of the present invention provides a method to control an image forming device. The method includes setting a type of paper to form an image; judging the set type of paper and a current feed mode, if the current feed mode is set as a cassette feed and the set type of paper is judged unsupportable by the cassette, converting the set type of paper into a supportable type of paper, which has a fixing temperature similar to that of the set type of paper and is supportable in the cassette, and determining values of fixing temperature and high voltage of the converted type of paper; and forming an image on a paper fed from the cassette according to the determined values of fixing temperature and high voltage.

If the judging operation determines that the current feed mode is set as the cassette feed and the set type of paper is unsupportable by the cassette, the method of the invention may further comprise the operation of generating a warning message.

Another aspect of the present invention provides a method to control an image forming device. The method includes setting a type of paper to form an image; judging the set type of paper and a current feed mode; generating a warning message if the feed mode is judged to be a cassette feed mode and the set type of paper is unsupportable by a cassette, counting a time lapse after generation of the warning message, if the counted time lapse is longer than a set reference time, converting the set type of paper into a supportable type of paper, which has a fixing temperature similar to that of the set type of paper and is supportable by the cassette, and determining values of fixing temperature and high voltage of the converted type of paper; and forming an image on a paper fed from the cassette according to the determined values of fixing temperature and high voltage.

If a user inputs a signal to cancel the warning message or a reset signal while the time lapse is counted after generation of the warning message, the determining operation comprises converting the set type of paper into a supportable type of paper, which has a fixing temperature similar to that of the set type of paper and is supportable by the cassette, and determining values of fixing temperature and high voltage of the converted type of paper.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 7 is a table reporting fixing temperatures according to types of paper.

DETAILED DESCRIPTION OF THE PREFERRED EMBODIMENTS

Figure 1:
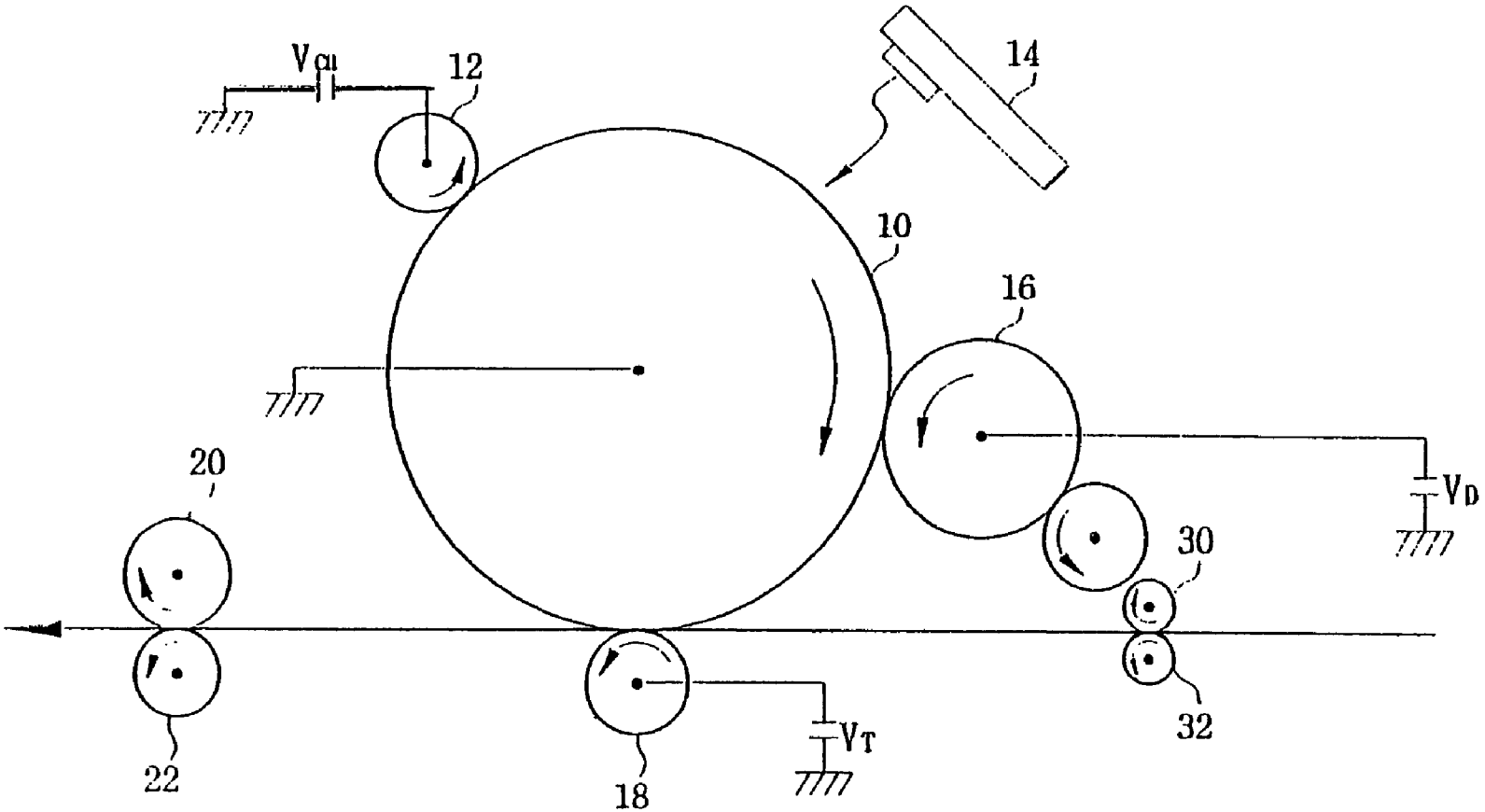
FIG. 1 PRIOR ART
FIG. 1 schematically illustrates an engine mechanism in an electrophotographic image forming device utilizing contact electrification.

Reference will now be made in detail to the embodiments of the present invention, examples of which are illustrated in the accompanying drawings, wherein like reference numerals refer to the like elements throughout. The embodiments are described below to explain the present invention by referring to the figures.

The following detailed description will present a method and apparatus to control a set paper in an image forming device of the present invention with reference to the appended drawings.

Figure 2:
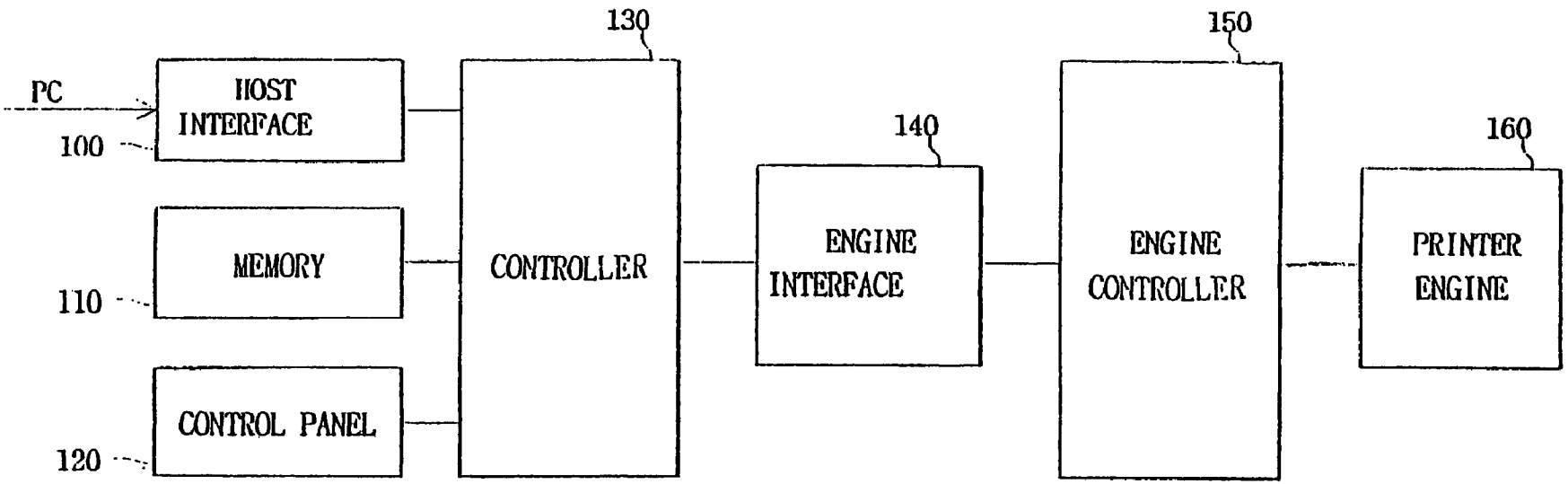
FIG. 2 PRIOR ART
FIG. 2 is a block diagram schematically illustrating an image forming device of the prior art.
Figure 3:
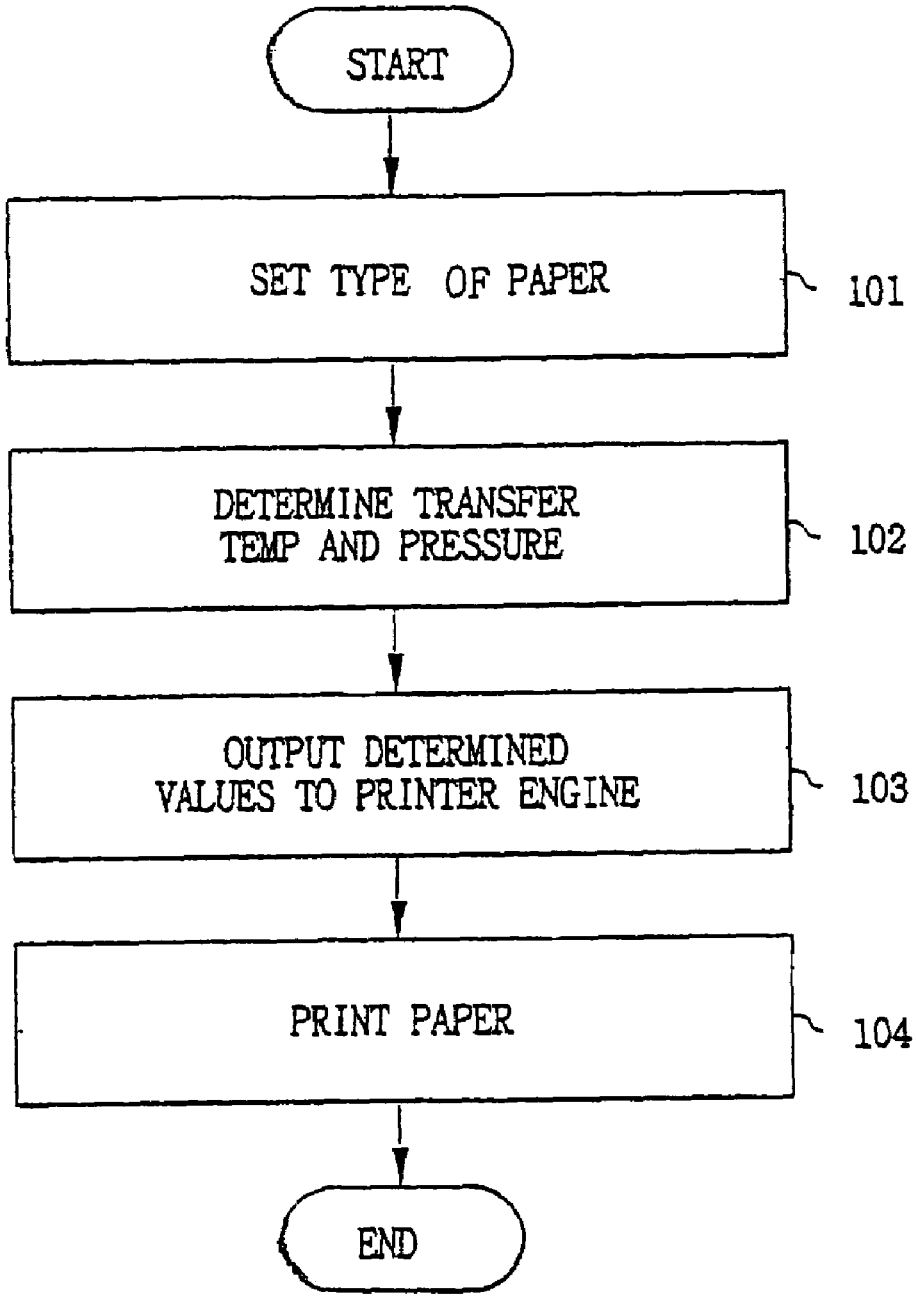
FIG. 3 PRIOR ART
FIG. 3 is a flow chart schematically illustrating a process of controlling a set paper in an image forming device of the related art.
Figure 4:
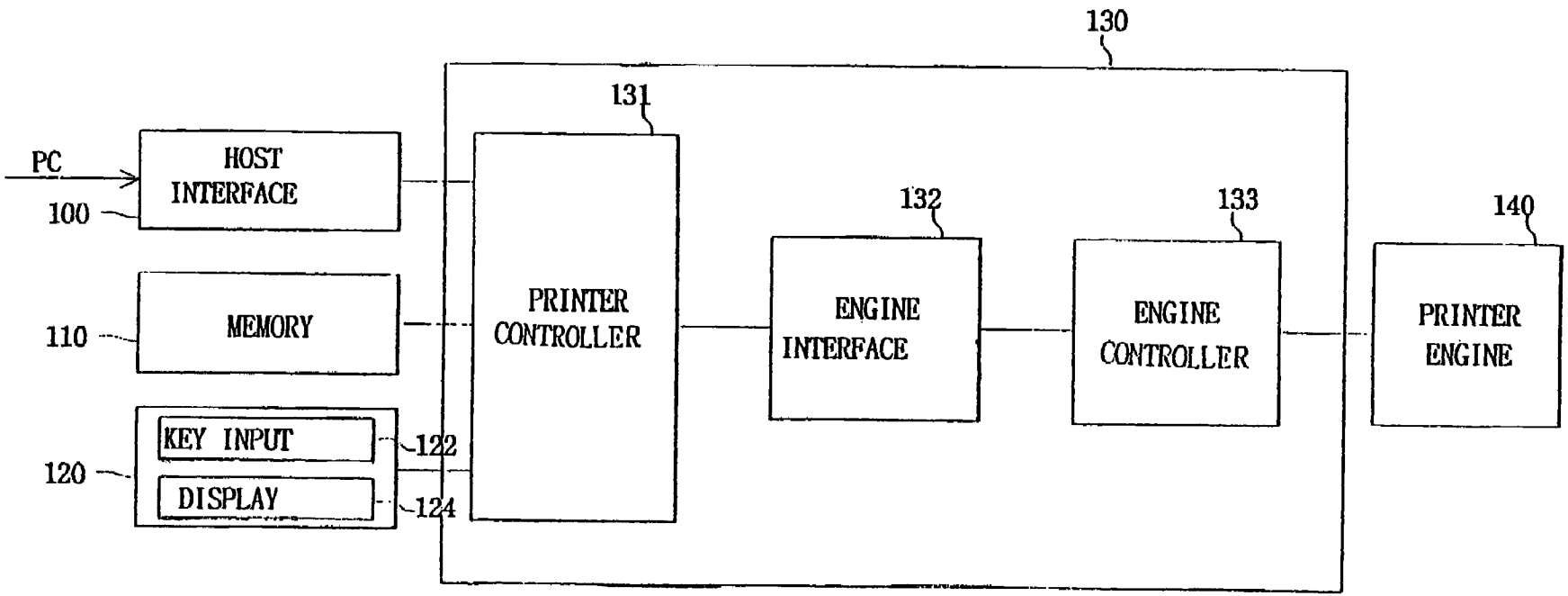
FIG. 4 is a block diagram of an apparatus to control a set paper in an image forming device in accordance with the present invention.

FIG. 4 is a block diagram of an apparatus to control a set paper in an image forming device in accordance with the present invention, in which the components, which are the same or similar to those in FIG. 2, are designated with the same reference numerals and detailed description thereof will be omitted for the sake of convenience.

As shown in FIG. 4, the set paper controlling apparatus in the image forming device includes a controller 130. The controller 130 sets a type of paper in response to a paper-setting instruction signal which is received through a key input 122 of a control panel 120. In a cassette mode to feed papers from the cassette, the controller 130 judges whether the set type of paper belongs to those which are supported by the cassette. Then, the controller 130 determines values of fixing temperature and high voltage according to the set type of paper, and then provides the values to a printer engine 140.

The set paper controlling apparatus of the invention may further include a display 124 to alarm a user with a warning message when the controller 130 judges that the set type of paper is not supported by the cassette. The display 124 may be included as a display in the control panel 120 or a separate display. The display 124 may utilize at least one of a group including an LCD, an LED and a buzzer in order to output the warning message in the form of a text, beam or sound.

The controller unit 130 may include a printer controller 131, an engine interface 132 and an engine controller 133.

The printer controller 131 provides paper-setting data, which are inputted via the host interface 100 or the key input 122 of the control panel 120, to the engine controller 133 through the engine interface 132.

The engine controller 133 judges a paper feed mode based upon the paper-setting data inputted through the engine interface 132. If the paper feed mode is set as the cassette mode, the engine controller judges whether the set type of paper is supported by the image forming device or the cassette.

If the set type of paper is judged to be unsupportable, the engine controller 133 converts the set type of paper into a similar type of paper which can be supported by the cassette, and determines a fixing temperature and a high voltage corresponding to the converted type of paper, which are in turn provided to the printer engine 140. That is, the printer engine 140 forms an image on the paper which is fed from the cassette based upon the fixing temperature and the high voltage provided from the engine controller 133.

Hereinafter a detailed operation of the set paper controlling apparatus in an image forming device of the invention will be described in detail.

First, the user operates the key input 122 in the control panel of the printer itself or the printer driver of the personal computer to set the type of paper to be printed, which is then provided to the printer controller 131 of the controller 130. The printer controller 131 provides the type of paper to be printed and the associated paper feed data, which are inputted via the key input 122 of the control panel 120 or the host interface 100, to the engine controller 133 via the engine interface 132. The engine controller 133 analyzes the type of paper data to be printed and the paper feed data which are inputted from the printer controller 131 via the engine interface 132 to judge whether the image forming device is fed with papers in a manual or cassette mode.

Since the image forming device set to the manual mode supports all types of papers, the engine controller 133 determines the values of fixing temperature and high voltage based upon the set type of paper to be printed. Then, the engine controller 133 provides the values of fixing temperature and high voltage to the printer engine 140 so that the printer engine 140 forms the image on the corresponding paper according to the values of fixing temperature and high voltage from the engine controller 140.

If the cassette mode is judged to have been currently set, the engine controller 133 judges whether the set type of paper is supportable by the corresponding cassette. If the set type of paper is supportable by the corresponding cassette, the engine controller 133 provides the printer engine 140 with the previously set values of fixing temperature and high voltage corresponding to the set type of paper so that the printer engine 140 picks up the paper from the associated cassette to print the image on the paper.

However, when the paper feed mode is set as the cassette mode with the set type of paper unsupported by the associated cassette, the engine controller 133 converts the set type of paper into a supportable type of paper, which is most similar to the set type of paper, and then provides the printer engine 140 with values of fixing temperature and high voltage of the converted type of paper.

Alternatively, when the paper feed mode is set as the cassette mode with the set type of paper unsupported by the associated cassette, the engine controller 133 outputs a warning message via the display 124 in the control panel 120 or via a buzzer (not shown) in order to notify that the set type of paper is not supported by the image forming device.

While the display 124 or the buzzer is generating the warning message that the set type of paper is not supported, if the user inputs a warning message reset signal via the key input 122 to cancel the warning message, the engine controller 133 converts the set type of paper into the supportable type of paper, which is most similar to the set type of paper, and then provides the printer engine 140 with the values of fixing temperature and high voltage corresponding to the converted type of paper.

Then, the printer engine 140 forms the image on the associated printing paper in response to the values of fixing temperature and high voltage which are provided from the engine controller 133.

Further, where a warning message or the warning message is generated via the display 124 of the control panel 120 or a separate buzzer, the engine controller 133 counts a time lapse. If any reset signal is not inputted from the user even after a set reference time, the engine controller 133 may automatically convert the set type of paper into a supportable type of paper to control the process of forming an image. The engine controller 133 may comprise a counter to count the time lapse with respect to the set reference time after generation of the warning message.

First Embodiment

Figure 5:
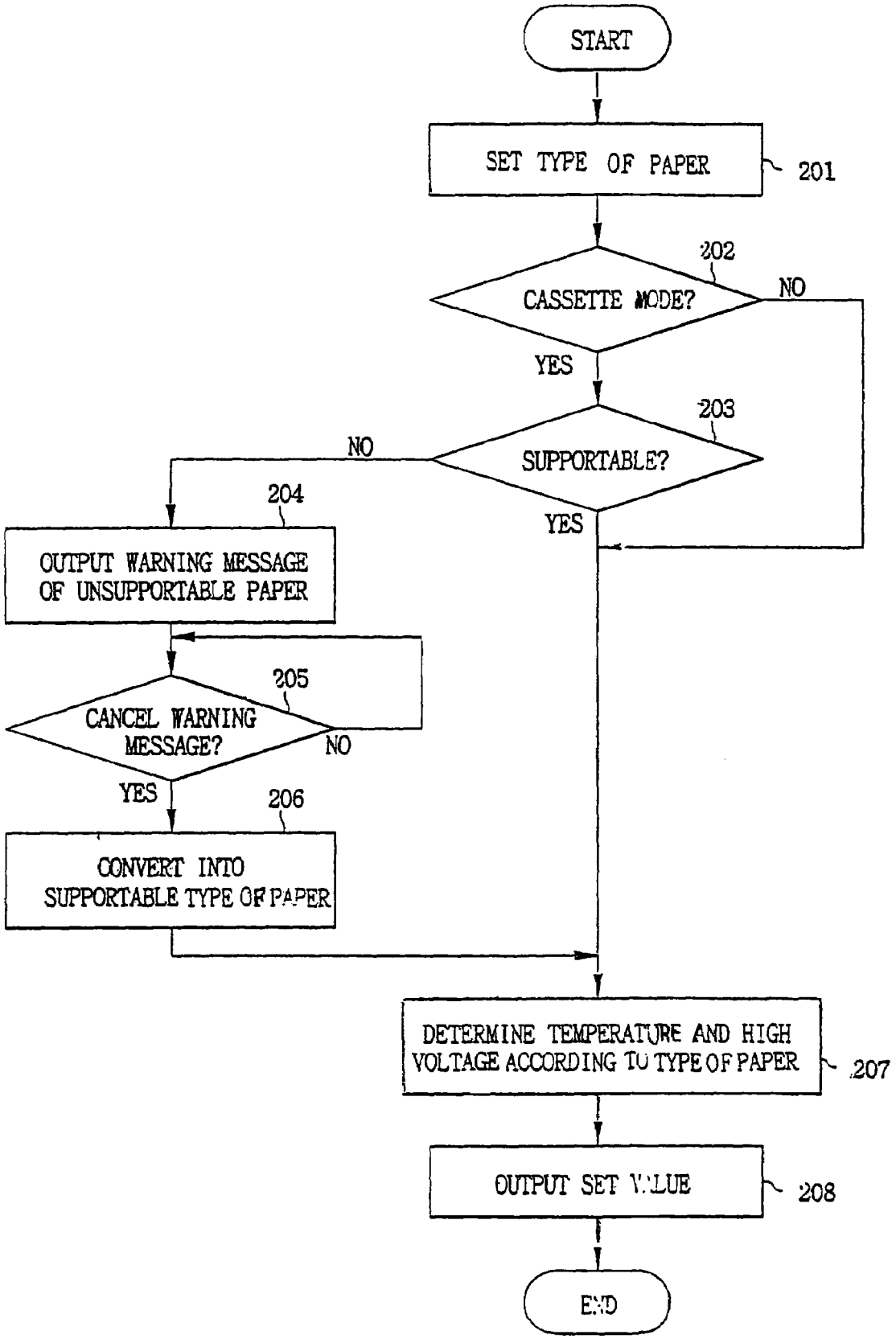
FIG. 5 is a flowchart illustrating a process to control a set paper in an image forming device according to an embodiment of the invention.

FIG. 5 is a flowchart illustrating a process to control a set paper in an image forming device according to a first embodiment of the invention.

As shown in FIG. 5, a user sets the type of a paper to be printed via a printer driver in a PC or a key input 122 of a control panel 120 in an image forming device in operation 201. After the type of paper is set by the user, an engine controller 133 judges whether the paper is fed from a cassette in operation 202. If the set paper is judged to have been fed from the cassette, that is, the set paper is fed in a cassette mode, the engine controller 133 judges whether the set type of paper is supportable by the associated cassette in operation 203.

If the set type of paper is unsupportable by the associated cassette, the engine controller 133 outputs a warning message that the set paper is not supported by the cassette in operation 204. The warning message may be displayed via a display 124 of the control panel 120, as shown in FIG. 4, or a separate display. Alternatively, the warning message may be generated in the form of a text or audio warning message via an LCD, an LED or a buzzer.

As the warning message is generated, the engine controller 133 judges whether a warning message cancel signal, that is, a signal to cancel the warning message or a reset signal is inputted by the user in operation 205. If the warning message cancel signal or the reset signal is judged to have been input by the user, the engine controller 133 converts the set type of paper into a supportable type of paper which has image forming conditions similar to those of the set type of paper and is supportable by the associated cassette in operation 206. However, if the warning message cancel signal or the reset signal is not input by the user, the engine controller 133 continuously generates the warning message or counts a time.

If the counted time reaches at least a set reference time, the engine controller 133 stops outputting the warning message and then converts the set type of paper into a supportable type of paper which has image forming conditions similar to those of the set type of paper and is supportable by the associated cassette in operation 206. Upon conversion of the type of paper, the engine controller 133 determines values of fixing temperature and high voltage according to the converted type of paper, and provides the determined values of fixing temperature and high voltage to a printer engine 140 in operation 207. Then, the printer engine 140 forms an image on an associated paper according to the values of fixing temperature and high voltage from the engine controller 133 in operation 208.

If the current feed mode is judged to have been set as a manual mode instead of a cassette mode in operation 202 or the set type of paper is judged to be supportable by the associated cassette in operation 203, the engine controller 133 determines a fixing temperature and high voltage values according to the set type of paper and provides the determined values of fixing temperature and high voltage to the printer engine 140 in operation 207. Then, the printer engine 140 forms an image on the associated paper according to the fixing temperature and high voltage values provided from the engine controller 133 in operation 208.

The method to control a set paper in an image forming device according to the first embodiment of the invention is as follows. First, the type of paper is set via an operation of the printer driver or the panel in the device itself. Since the manual feed mode supports substantially all types of papers, a process to form an image on the set paper is substantially equal to a conventional method. However, if the feed mode is the cassette mode, whether the set type of paper is supportable by the associated cassette to form the image is judged. If the set type of paper is judged to be supportable by the associated cassette, the image forming process is performed according to the set type of paper. In the meantime, if the set type of paper is not supported by the associated cassette, the warming message is generated to inform the user that the type of paper is set incorrect.

Upon generation of the warning message, the warning message can be canceled via operation of the key input in the control panel in order to proceed printing regardless of the warning message. If the warning message is canceled, the paper setting is converted to a different type of paper which is supported by the cassette, and a control routine is executed with respect to a fixing temperature and a high voltage unit according to the converted type of paper. If the warning message is not canceled due to the warning message being disregarded, the warning message may be generated successively. Alternatively, a time lapse may be counted with a counter (not shown), and when a counted time reaches a set reference time, the warning message is automatically canceled and the set type of paper is converted to a different type of paper. Then, an image forming process may be carried out according to fixing temperature and high voltage values of the converted type of paper.

As an example, when the user selects an envelope or a card and inputs an image forming (printing) instruction in an image forming device which does not support the envelope or the card in a cassette, a warning message is generated from the device. If the user inputs a cancel signal via the cancel key in order to proceed image with the forming process regardless of the warning message, the set type of paper is converted into a different type of paper which has image forming conditions similar to those of the set type of paper and which is supportable by the cassette.

As an example, if a bonded paper is most similar with respect to printing conditions to the envelope and supportable by the cassette, the set type of paper is converted into the bonded paper and then the image is formed on a set bonded paper according to a fixing temperature and a high voltage corresponding to the bonded paper.

Second Embodiment

Figure 6:
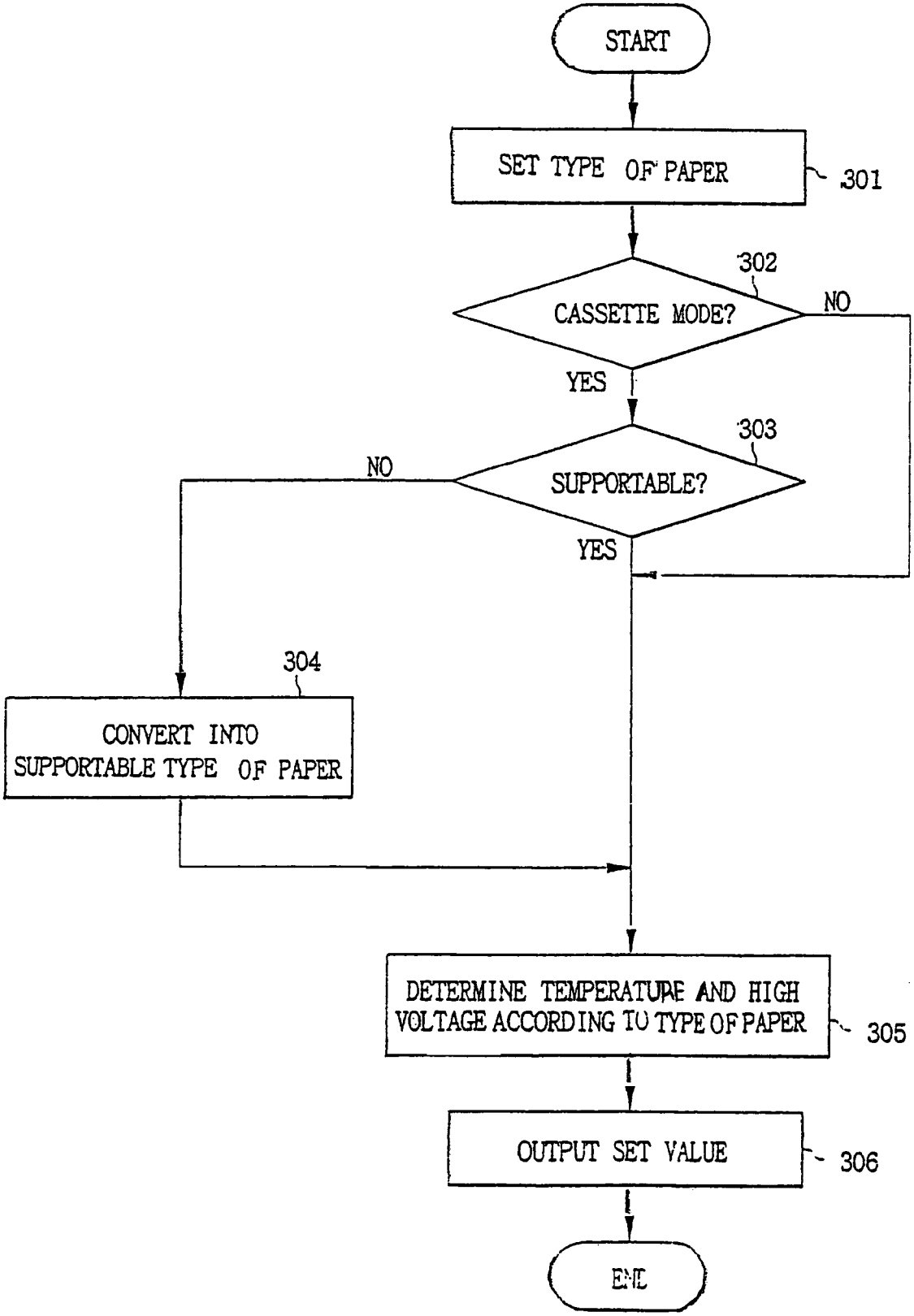
FIG. 6 is a flowchart illustrating a process to control a set paper in an image forming device according to another embodiment of the invention.

FIG. 6 is a flowchart illustrating a process to control a set paper in an image forming device according to a second embodiment of the invention.

As shown in FIG. 6, a user sets the type of a paper to be printed via a printer driver in a PC or a key input 122 of a control panel 120 in an image forming device in operation 301.

After the type of paper is set by the user, an engine controller 133 judges whether the paper is fed from a cassette in operation 302. If the set paper is judged to have been fed from the cassette, that is, the set paper is fed in a cassette mode, the engine controller 133 judges whether the set type of paper is supportable by the associated cassette in operation 303. If the set type of paper is unsupportable by the associated cassette, the engine controller 133 converts the set type of paper into a supportable type of paper which has image forming conditions similar to those of the set type of paper and is supportable by the associated cassette in operation 304.

Upon conversion of the type of paper, the engine controller 133 determines values of fixing temperature and high voltage according to the converted type of paper, and provides the determined values of fixing temperature and high voltage to a printer engine 140 in operation 305. Then, the printer engine 140 forms an image on an associated paper according to the values of fixing temperature and high voltage from the engine controller 133 in operation 306.

If the current feed mode is judged to have been set in a manual mode instead of a cassette mode in operation 302 or the set type of paper is judged to be supportable by the associated cassette in operation 303, the engine controller 133 determines fixing temperature and high voltage values according to the set type of paper, and provides the determined values of fixing temperature and high voltage to the printer engine 140 in operation 305. Then, the printer engine 140 forms an image on an associated paper according to the values of fixing temperature and high voltage from the engine controller 133 in operation 306.

The method to control a set paper in an image forming device according to the second embodiment of the invention, where the set type of paper is unsupportable by the cassette, directly converts the set type of paper into the type of paper supportable by the associated cassette. Then, the image is formed according to the fixing temperature and high voltage values of the converted type of paper.

Herein fixing temperatures of several well-known types of paper will be discussed briefly with reference to FIG. 7.

FIG. 7 is a table reporting fixing temperatures according to types of paper in a general image forming device.

As shown in FIG. 7, a thin type of paper shows a fixing temperature of 172° C., a plain type of paper shows a fixing temperature of 189° C., a bonded type of paper and a label show a fixing temperature of 199° C., a card and an envelope show a fixing temperature of 208° C., and an OHP type shows a fixing temperature of 165° C.

Although the fixing temperatures of the types of paper are variable according to the surrounding environment, the number of printed papers and time, the fixing temperatures seen in FIG. 7 represent initial fixing temperatures for example.

As set forth above, when the user sets a type of paper unsupported by a cassette, the method and apparatus to control a set paper in an image forming device of the present invention generates a warning message to inform that setting is incorrect, and resets the type of paper in response user selection or converts the set type of paper into a different type of paper which has printing conditions similar to those of the set type of paper and is supportable by the cassette in order to prevent degradation of image quality in the unsupportable type of paper.

Furthermore, although a paper such as an envelope or a card requiring a high fixing temperature is set, when a thin paper is inserted into the cassette to be printed, a printer engine can be protected from an unsuitably high temperature.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electrophotographic image forming device having a cassette, the device comprising:

a controller, wherein the controller sets a type of paper, judges whether the type of paper is supported by the cassette if a paper feed mode is set as a cassette mode, determines values of fixing temperature and high voltage according to the type of paper, and forms an image on an associated paper according to the determined values of fixing temperature and high voltage.

2. The device according to claim 1, further comprising a display to display a warning message if the controller judges that the set type of paper is unsupportable by the cassette.

3. The device according to claim 1, wherein the display comprises at least one of a group including an LCD, an LED and a buzzer.

4. The device according to claim 1, if the set type of paper is judged to be unsupportable by the cassette, the controller selects a supportable type of paper having image forming conditions similar to those of the set type of paper and determines values of fixing temperature and high voltage according to the selected supportable type of paper to form the image.

5. A method to control an image forming device, the method comprising:

setting a type of paper to form an image;

judging the set type of paper and a current feed mode, wherein if the current feed mode is set as a cassette feed and the set type of paper is judged to be unsupportable by the cassette, converting the set type of paper into a supportable type of paper, which has a fixing temperature similar to that of the set type of paper and is supportable in the cassette, and determining values of fixing temperature and high voltage of the converted type of paper; and forming an image on a paper fed from the cassette according to the determined values of fixing temperature and high voltage.

6. The method according to claim 5, wherein when the judging determines that the current feed mode is set as the cassette feed and the set type of paper is unsupportable by the cassette, the method further comprises generating a warning message.

7. The method according to claim 6, wherein the warning message is generated in a form of a text message or a sound by using at least one of a group including an LCD, an LED and a buzzer.

8. A method to control an image forming device, the method comprising:

setting a type of paper to form of an image;

judging the set type of paper and a current feed mode;

generating a warning message if the feed mode is judged to be a cassette feed and the set type of paper is unsupportable by a cassette feed, counting a time lapse after generation of the warning message, wherein if the counted time lapse is longer than a set reference time, converting the set type of paper into a supportable type of paper, which has a fixing temperature similar to that of the set type of paper and is supportable by the cassette, and determining values of fixing temperature and high voltage of the converted type of paper; and forming an image on a paper fed from the cassette according to the determined values of fixing temperature and high voltage.

9. The method according to claim 8, wherein the warning message is generated in the form of a text message or a sound by using at least one of a group including an LCD, an LED and a buzzer.

10. The method according to claim 8, wherein when a user inputs one of a signal to cancel the warning message and a reset signal while the time lapse is counted after the generation of the warning message, the determining operation comprises converting the set type of paper into a supportable type of paper, which has a fixing temperature similar to that of the set type of paper and is supportable by the cassette, and determining values of fixing temperature and high voltage of the converted type of paper.

11. A controller of an electrophotographic image forming device, having a printer engine, the controller comprising:

an engine interface;

a printer controller to provide inputted paper setting data through the engine interface; and an engine controller to judge a paper feed mode based upon the paper setting data inputted through the engine interface and to judge whether the set type of paper is supported by the image forming device.

12. The controller according to claim 11, wherein if the set type of paper is judged to be unsupported, the engine controller converts the set type of paper into a similar type of paper which can be supported, and the engine controller determines a fixing temperature and a high voltage corresponding to the converted type of paper.

13. The controller according to claim 12, wherein the converted type of paper, the fixing temperature, and the high voltage are provided to the printer engine.

14. The controller according to claim 13, wherein the printer engine forms an image based upon the fixing temperature and the high voltage provided from the engine controller.

15. The controller according to claim 11, further comprising a display to alarm a user with a warning message when the controller judges that the set type of paper is not supported.

16. The controller according to claim 15, further comprising a control panel, wherein the display is included as a display in the control panel.

17. The controller according to claim 15, wherein the display utilizes at least one of a group including an LCD, an LED and a buzzer to output the warning message.

18. A method to control an image forming device, in which a user sets a type of paper, having image forming conditions, the method comprising:

judging whether the paper is to be fed from a cassette;

judging whether the set type of paper is supportable by the cassette, if the paper is to be fed from a cassette;

converting the set type of paper into a supportable type of paper having image forming conditions similar to those of the set type of paper, if the set type of paper is judged to not be supported; and determining values of the image forming conditions of the converted set type of paper.

19. The method according to claim 18, further comprising:

generating a warning message that the set type of paper is not supported;

outputting the warning message; and judging whether the warning message cancel signal is inputted by the user, wherein the generating, outputting, and judging whether the warning message cancel signal is inputted are conducted before the converting operation.

20. The method according to claim 19, wherein the outputting comprises displaying the warning message via a display in the control panel.

21. The method according to claim 19, wherein the outputting comprises displaying the warning message via a display, which is separate from the image forming device.

22. The method according to claim 19, wherein the outputting comprises generating a text message via at least one of an LCD and an LED.

23. The method according to claim 19, wherein the outputting comprises generating an audio message via a buzzer.

24. The method according to claim 19, further comprising counting a period of time wherein if the counting reaches a reference time, and the warning message cancel signal has not been inputted, the converting operation is begun.

25. The method according to claim 18, further comprising providing the determined values image forming conditions to the printer engine.

26. The method according to claim 24, further comprising forming an image according to the determined image forming conditions.

27. The method according to claim 18, wherein if the paper is judged to be fed manually, or if the set type of paper is judged to be supported, image forming conditions of the set type of paper are determined and provided to the printer engine.

28. The method according to claim 26, further comprising forming an image according to the determined image forming conditions.

* * * * *

UNITED STATES PATENT AND TRADEMARK OFFICE

CERTIFICATE OF CORRECTION

PATENT NO. : 7,066,666 B2
APPLICATION NO. : 10/845136
DATED : June 27, 2006
INVENTOR(S) : Seok-Heon Chae It is certified that error appears in the above-identified patent and that said Letters Patent is hereby corrected as shown below:

Column 12, Line 51, after "values" insert --of the--.

Signed and Sealed this

Thirtieth Day of January, 2007

JON W. DUDAS
*Director of the United States Patent and Trademark Office*